United States Patent [19]

Mader et al.

[11] Patent Number: 4,782,010

[45] Date of Patent: Nov. 1, 1988

[54] PHOTOHERMOGRAPHIC EMULSIONS HAVING STABLE COLOR FORMING DEVELOPERS

[75] Inventors: Roger A. Mader; David C. Weigel; Louis M. Leichter; Kristen A. Hoff, all of St. Paul, Minn.

[73] Assignee: Minnesota Mining and Manufacturing Company, St. Paul, Minn.

[21] Appl. No.: 946,969

[22] Filed: Dec. 29, 1986

[51] Int. Cl.[4] ..... G03C 1/40; G03C 1/26

[52] U.S. Cl. ..... 430/538; 430/559; 430/619; 430/620; 430/570; 430/551; 430/964; 430/351

[58] Field of Search ..... 430/617, 619, 620, 559, 430/203, 351, 538, 570, 551, 964, 531

[56] References Cited

U.S. PATENT DOCUMENTS

| | | | |
|---|---|---|---|
| 3,873,340 | 3/1975 | Miyazawa et al. | 117/36.8 |
| 3,985,565 | 10/1976 | Gabrielsen et al. | 430/203 |
| 4,022,617 | 5/1977 | McGuckin | 430/351 |
| 4,370,401 | 1/1983 | Winslow et al. | 430/178 |
| 4,379,835 | 4/1983 | Lowrey et al. | 430/351 |
| 4,670,374 | 6/1987 | Bellus | 430/351 |

FOREIGN PATENT DOCUMENTS 47-4638 3/1972 Japan .

*Primary Examiner*—Won H. Louie

*Attorney, Agent, or Firm*—Donald M. Sell; Mark A. Litman

[57] ABSTRACT

The use of phenazine, phenoxazine and phenothiazine color forming developers in photothermographic dry silver emulsions provides a stable imaging system under both light and dark storage.

30 Claims, No Drawings

PHOTOHERMOGRAPHIC EMULSIONS HAVING STABLE COLOR FORMING DEVELOPERS

BACKGROUND OF THE INVENTION

1. Field of the Invention

The present invention relates to photothermographic dry silver elements containing color forming developers.

2. Prior Art

Photosensitive, heat-developable, dry silver sheet materials, as described for example in U.S. Pat. Nos. 3,457,075 and 3,839,049, contain a photosensitive silver halide catalyst-forming means in catalytic proximity with a heat sensitive combination of a light stable organic silver compound and a reducing agent therefor. When struck by light, the silver halide catalyst-forming means produces silver nuclei which serve to catalyze the reduction of the organic silver compound, e.g., silver behenate, by the reducing agent at elevated temperatures. To improve the image density and color it has been found desirable to include toners in the sheet construction.

Color photothermographic imaging systems have been described in patent literature. U.S. Pat. No. 3,531,286 describes a system using paraphenylenediamine and photographic color couplers. U.S. Pat. No. 3,985,565 discloses the use of phenolic leuco dye reducing agents to reduce the silver and provide a color image. U.S. Pat. No. 4,460,681 discloses a multilayer color photothermographic system using a variety of leuco dyes separated by barrier layers.

U.S. Pat. No. 3,873,340 describes a pressure-sensitive copying paper comprising an encapsulated phenoxazine compound generically inclusive of some of the developers described in the present invention.

U.S. Pat. No. 4,370,401 describes a photosensitive, thermally developable imaging system which contains leuco dyes. At least one of the described leuco dyes is within the scope of developers recited in the present invention.

Japanese Patent Publication 47-4638 (1972) referenced in *Chemical Abstracts*, 40-Dyes, Vol. 77, 1972, 21570r describes thiazine dyes including N-[arylsulfonyl] phenothiazines as color formers in pressure sensitive papers.

BRIEF DESCRIPTION OF THE INVENTION

The use of phenoxazine, phenothiazine and phenazine leuco dyes having an oxidation stabilized phenolic group in color forming photothermographic dry silver elements provides storage stability, both in light and dark conditions, to the photothermographic element.

DETAILED DESCRIPTION OF THE INVENTION

In order to provide a full spectrum of color in the final image of a color photothermographic element, a wide variety of leuco dyes providing different final colors should be available. Many leuco dyes tend to be highly sensitive to the active environment of a photothermographic emulsion. This sensitivity can occur either to the leuco dye or to the dye generated by oxidation of the leuco dye.

The dyes of use in the practice of the present invention are generally described in the formula:

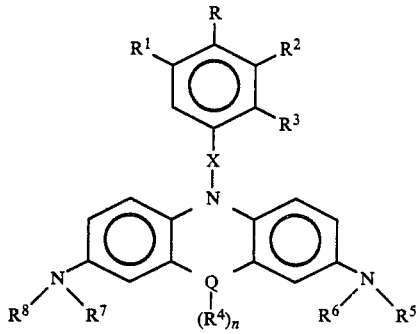

wherein

R=OH, or when $R^3$ is OH, R may be H or with $R^1$ or $R^2$ form a fused benzene ring;

$R^1$ and $R^2$ are selected from H, or a substituent having a diameter at least equal to that of —Br and equal to or less than 1,1,3,3,5,5-hexamethyl hexyl or less than tertiary octyl, e.g., Br, t-butyl, t-octyl, ethylhexyl, cyclohexyl, and is preferably a branched, cyclic alkyl, or aliphatic-cyclic alkyl, with no more than one of $R^1$ and $R^2$ being H, and $R^1$ or $R^2$ may with R form a fused benzene ring, and $R^2$ may with $R^3$ a fused benzene ring;

$R^3$ may be H, OH or may form with $R^2$ a fused benzene ring;

$R^4$ may be H, alkyl (preferably 1 to 12 carbon atoms, substituted or not), aryl (preferably phenyl, substituted or not, with 6 to 10 ring atoms), aralkyl (preferably 7 to 20 carbon atoms, e.g., tolyl), or alkaryl (preferably 7 to 20 carbon atoms, e.g., m-ethyl-phenyl);

$R^5$, $R^6$, $R^7$ and $R^8$ may be independently selected from H, alkyl (preferably 1 to 12 carbon atoms, substituted or not), aryl (e.g., phenyl, naphthyl, and anthryl, substituted or not), and one of $R^5$ and $R^6$, and one of $R^7$ and $R^8$ may be W;

X is carbonyl, sulfonyl, carboxyl, amido (i.e., CONH—, and CON-alkyl) or phosphonyl;

Q is N, S, O or C;

n is zero for Q equals S or O, n is 1 for Q equals N, and 2 for Q equals C; and W is a group of the formula

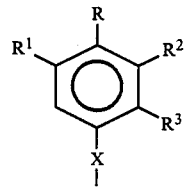

wherein R, $R^1$, $R^2$, $R^3$ and X are as defined above.

These color forming developers should be present in the emulsion at a minimum quantity sufficient to provide a transmission optical density of at least 0.5 upon oxidation of 100% of the developers. This will usually be 0.05 to 10% by weight of the layer the developer is in, preferably 0.1 to 5% by weight of that layer. This may alternatively be expressed as being present in an amount equal to about 1 to 35% by weight of the silver present in reactive association with the developer.

Photothermographic dry silver emulsions are usually constructed as one or two layers on a substrate. Single layer constructions must contain the silver source material, the silver halide in catalytic proximity to the silver source, the developer in reactive association with the silver source material, and binder as well as optional additional materials such as toners, coating aids and other adjuvants. Two-layer constructions must contain the silver source and silver halide in one emulsion layer (usually the layer adjacent the substrate) and some of the other ingredients in the second layer or both layers.

The terms catalytic proximity and reactive association are well known in the art. Catalytic proximity means that silver formed in the silver halide is in such physical proximity to the organic silver salt that it can act as a catalyst in the thermally activated reduction of the silver organic salt. Reactive association means that the color forming developer is in such physical proximity to the organic silver salt that upon thermal activation the developer can reduce the organic silver salt.

The silver source material, as mentioned above, may be any material which contains a reducible source of silver ions. Silver salts of organic acids, particularly long chain (10 to 30, preferably 15 to 28 carbon atoms) fatty carboxylic acids are preferred. Complexes of organic or inorganic silver salts wherein the ligand has a gross stability constant between 4.0 and 10.0 are also desirable. The silver source material should constitute from about 20 to 70 percent by weight of the imaging layer. Preferably it is present as 30 to 55 percent by weight. The second layer in a two-layer construction would not affect the percentage of the silver source material desired in the single imaging layer.

The silver halide may be any photosensitive silver halide such as silver bromide, silver iodide, silver chloride, silver bromoiodide, silver chlorobromoiodide, silver chlorobromide, etc., and may be added to the emulsion layer in any fashion which places it in catalytic proximity to the silver source. The silver halide is generally present as 0.75 to 15 percent by weight of the imaging layer, although larger amounts up to 20 or 25 percent are useful. It is preferred to use from 1 to 10 percent by weight silver halide in the imaging layer and most preferred to use from 1.5 to 7.0 percent.

The reducing agent for silver ion may be any material, preferably organic material, which will reduce silver ion to metallic silver. Conventional photographic developers such as phenidone, hydroquinones, and catechol are useful, but hindered phenol reducing agents are preferred. The reducing agent should be present as 1 to 10 percent by weight of the imaging layer. In a two-layer construction, if the reducing agent is in the second layer, slightly higher proportions, of from about 2 to 15 percent tend to be more desirable.

Toner materials may also be present, for example, in amounts of from 0.2 to 10 percent by weight of all silver-bearing components. Toners are well known materials in the photothermographic art as shown by U.S. Pat. Nos. 3,080,254; 3,847,612 and 4,123,282.

The binder may be selected from any of the well-known natural and synthetic resins such as gelatin, polyvinyl acetals, polyvinyl chloride, polyvinylidene chloride, polyvinyl acetate, cellulose acetate, polyolefins, polyesters, polystyrene, polyacrylonitrile, polycarbonates, and the like. Copolymers and terpolymers are of course included in these definitions. The polyvinyl acetals, such as polyvinyl butyral and polyvinyl formal, and vinyl copolymers such as polyvinyl acetate/chloride are particularly desirable. The binders are generally used in a range of from 20 to 75 percent by weight of each layer, and preferably about 30 to 55 percent by weight.

For use on paper or other non-transparent backings it is found convenient to use silver half-soaps, of which an equimolar blend of silver behenate and behenic acid, prepared by precipitation from aqueous solution of the sodium salt of commercial behenic acid and analyzing about 14.5 percent silver, represents a preferred example. Transparent sheet materials made on transparent film backing require a transparent coating and for this purpose the silver behenate full soap, containing not more than about four or five percent of free behenic acid and analyzing about 25.2 percent silver, may be used. Other components, such as coloring, opacifiers, extenders, spectral sensitizing dyes, etc. may be incorporated as required for various specific purposes. Antifoggants, such as mercuric salts and tetrachlorophthalic anhydride, may also be included in the formulation.

The dyes used in the practice of the present invention may be produced by various synthetic procedures known in the art such as those of U.S. Pat. No. 3,873,340, and Japanese Patent Publication 47-4638. The following synthetic procedures exemplify methods by which the dyes of the present invention may be made by selection of the appropriate reagents.

1. Preparation of 10-(3,5-di-t-butyl-4-hydroxybenzoyl)3,7-diethylaminophenoxazine A solution containing 4.29 g of 10-benzoyl-3,7-diethylaminophenoxazine in 15 ml of tetrahydrofuran was added to 26 ml of 1M lithium triethylborohydride in tetrahydrofuran. After the addition was complete, the mixture was stirred for one hour. To this was added, over 15 minutes, 3.1 grams of 4-hydroxy-3,5-di-t-butylbenzoyl chloride. The mixture was stirred for one hour. Water was added and the product extracted into ethyl acetate. The solvent was removed and the product filtered through a pad of silica gel, and eluted with 1:3 ethyl acetate-hexane. Additional chromatography over alumina and elution with 1:4 ethyl acetate-hexane followed by recrystallization from etherhexane and finally from methanol gave 0.6 gm of the color forming developer.

2. Preparation of 10-(3,5-di-t-butyl-4-hydroxybenzoyl)3,7-di-(methyl,1,1,1-trifluoro ethylamino), 5-(4-methoxyphenyl) phenazine To a solution of 0.73 g of 10-(2,4-dichlorobenzoyl)3,7-di-(methyl,1,1,1-trifluoroethylamino), 5-(4-methoxyphenyl)phenazine in 15 ml of tetrahydrofuran was added 3.0 ml of 1M sodium triethylborohydride in tetrahydrofuran. The mixture was stirred for 30 minutes, then 0.52 g of 4-hydroxy-3,5-di-t-butylbenzoyl chloride was added. The solution was stirred for one hour, after which 20 ml of hexane was added and the organic phase separated. Chromatography of the crude product over alumina and elution with 1:5 ethyl acetate-hexane gave 0.1 g of the color forming developer.

3. Preparation of 10-(3,5-di-t-butyl-4-hydroxybenzoyl)-3,7-bis-(dimethylamino) phenothiazine Into a one liter 3-necked round bottomed flask, equipped with nitrogen blanket, Claisen adapter, rotary stirrer and pH probe, were placed 11.22 g (0.03 mol) of methylene blue trihydrate, 300 ml of methylene chloride, and 250 ml of water. Stirring was begun and upon dissolution of the dye, the pH was adjusted to 11 by addition of sodium hydroxide solution and the dye reduced by addition of 5.22 g (0.03 mol) of sodium dithionite. The pH began to drop and was maintained at 6 during the reduction by addition of sodium hydroxide solution. The two-phase solution was transferred to a separatory funnel, the methylene chloride layer removed, dried over magnesium sulfate, decolorized with attagel and the whole slurry filtered, through celite.

The green solution was transferred to another one liter 3-necked round bottomed flask equipped in identical fashion to that described above. To this was added 6.0 g of sodium bicarbonate and a solution of 8.06 g (0.03 mol) of 3,5-di-t-butyl-4-hydroxybenzoyl chloride (acid chloride) in 50 ml of methylene chloride. After 3 hours, an additional 4 g (0.015 mol) of acid chloride in 25 ml of methylene chloride was added and the solution allowed to stir overnight.

Filtration, followed by solvent removal at reduced pressure, afforded the crude material as a dark blue solid. Dissolution in toluene, chromatography on silica gel, and elution with 5% methanol in toluene gave the desired product. Two recrystallizations, first from toluene/hexane and then from toluene, afforded pure 10-(3,5-di-t-butyl-4-hydroxybenzoyl)-3,7-bis-(dimethylamino) phenothiazine; mp 212°-216° C. TLC indicated the material to be very pure.

4. Preparation of 10-(3-hydroxy-2-naphthoyl)-3,7-bis(diethylamino)-5-(4-methoxyphenyl) phenazine, Into a 500 ml 3-necked round bottomed flask, equipped with nitrogen blanket, Claisen adapter, rotary stirrer and pH probe, were placed 5.56 g (0.01 mol) of 3,7-bis(diethylamino)-5-(4-methoxyphenyl) phenazinium iodide, 150 ml of methylene chloride, and 125 ml of water. Stirring was begun and upon dissolution of the dye, the pH was adjusted to 11 by addition of sodium hydroxide solution and the dye reduoed by addition of 3.20 g (0.018 mol) of sodium dithionite. A solution of 3.00 g (0.015 mol) of 3-hydroxy-2-naphthoyl chloride in 5 ml of methylene chloride was added slowly. The pH dropped and the reaction mixture was maintained slightly basic by addition of small amounts of sodium hydroxide solution. Stirring was continued for 1.5 hour at which time a TLC indicated complete conversion to the leuco dye.

The pH was adjusted to 11, stirring was maintained for 15 minutes, and the reaction mixture transferred to a separatory funnel. Removal of the aqueous layer and washing the organic layer with water, was followed by drying of the organic layer over magnesium sulfate. Decolorization with attagel, filtration through celite to remove drying agent, and solvent removal at reduced pressure afforded the crude material. Recrystallization from acetone/heptane afforded the pure leuco dye as a yellow powder; mp 98°-100° C. TLC indicated the material to be very pure.

In addition to dyes (1), (2), (3) and (4) synthesized above, the following dyes can be prepared.

5. R=H, $R^1=R^2=H$, $R^3=OH$, $$X = -\overset{O}{\overset{\|}{C}}-,$$

Q=O, n=zero, $R^5=R^6=R^7=R^8=C_2H_5$

6. R and $R^1$ form a fused benzyl ring, $R^2=H$, $R^3=OH$, $$X = -\overset{O}{\overset{\|}{C}}-,$$

Q=O, n=zero, $R^5=R^6=R^7=R^8=C_2H_5$

7. R=OH, $R^1$ and $R^2$=t-butyl, $R^3=H$, $X=-SO_2-$, Q=S, n=0, $R^5=R^6=R^7=R^8=CH_3$ 8. R and $R^2$ form a fused benzene ring, $R^1=H$, $R^3=OH$, $$X = -\overset{O}{\overset{\|}{C}}-,$$

Q=O, N=zero, $R^5=R^6=R^7=R^8=C_2H_5$

9. R and $R^2$ form a fused benzene ring, $R^1=H$, $R^3=OH$, $$X = -\overset{O}{\overset{\|}{C}}-,$$

Q=N, n=1, $R^4$=4-methoxyphenyl, $R^5=R^6=R^7=R^8=C_2H_5$

10. $R=R^1=R^2=H$, $R^3=OH$, $$X = -\overset{O}{\overset{\|}{C}}-,$$

Q=N, n=1, $R^4$=4-methoxyphenyl, $R^5=R^7=H$, $R^6=R^8=W$ wherein [$R=R^1=R^2=H$, $R^3=OH$, $$X = -\overset{O}{\overset{\|}{C}}-]$$

11. R and $R^1$ form a fused benzene ring, $R^2=H$, $R^3=OH$, $$X = -\overset{O}{\overset{\|}{C}}-,$$

Q=N, n=1, $R^4$=4-methoxyphenyl, $R^5=R^7=H$, $R^6=R^8=W$ wherein [R and $R^1$ form a fused benzene ring, $R^2=H$, $R^3=OH$, $$X = -\overset{O}{\overset{\|}{C}}-]$$

12. R=OH, $R^1$ and $R^2$=t-butyl, $R^3=H$, $$X = -\overset{O}{\overset{\|}{C}}-,$$

Q=N, n=1, $R^4$=4-methoxyphenyl, $R^5=R^7=H$, $R^6=R^8=W$ wherein [R=OH, $R^1$ and $R^2$=t-butyl, $R^3=H$, $$X = -\overset{O}{\overset{\|}{C}}-]$$

EXAMPLES 1-5

A standard dry silver formulation was prepared comprising 127 g half-soap silver behenate
175 g toluene
12 ml $HgBr_2$/100 ml methanol
56 g poly(vinyl butyral)
72 g 120 g poly(vinyl chloride/vinyl acetate, 80/20) copolymer, 240 g toluene, 240 g methylethylketone
2 ml 20% by weight methanol solutions of sensitizing dye To 50 g of this formulation is added 0.2 g of the dye to be tested. The mixture is first coated at 3 mils wet thickness and dried at 180° F. (81° C.). A top coat solution of poly(styrene) in toluene and acetone (50/50) with 0.2 g of phthalazinone per 50 g of solution was overcoated on the dried first coating at 3 mils wet thickness and dried at 81° C.

Dyes 1-4 and 8-9 were used in these Examples. After imagewise exposure to white light through a 21-step wedge and thermal development for 15 seconds at 130° C., all sheets produced images. Particularly good visible images were maintained in the imaged films using dyes 1-4 even after two weeks exposure to fluorescent room light at 20° C. and 40% relative humidity.

When samples of the four films (dyes, 1-4) were kept in dark storage at 20° C. for two weeks, only small changes in the optical density over fog were noted.

What is claimed is:

1. A photothermographic emulsion capable of producing an image having visible color therein upon exposure to actinic radiation and thermal development comprising a binder, an organic silver salt, silver halide in catalytic proximity to said organic silver salt, and a dye forming developer in reactive association with said organic silver salt, said emulsion being characterized by the fact that said developer comprises a compound of the formula:

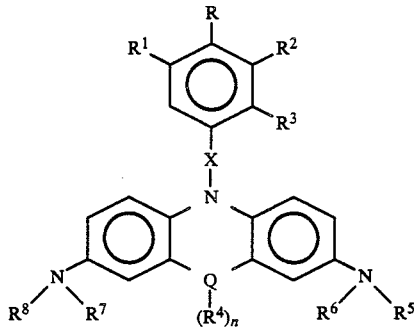

wherein

R=OH, or when $R^3$ is OH, R is H or combined with $R^1$ or $R^2$ to form a fused benzene ring;

$R^1$ and $R^2$ are selected from H, or a substituent having a diameter at least equal to that of —Br and equal to or less than 1,1,3,3,5,5-hexamethyl hexyl, with no more than one of $R^1$ and $R^2$ being H, and $R^1$ or $R^2$ may form with R a fused benzene ring, and $R^2$ may form with $R^3$ a fused benzene ring;

$R^3$ is H, OH or may form with $R^2$ a fused benzene ring;

$R^4$ is H, alkyl (substituted or not), aryl (substituted or not), aralkyl or alkaryl;

$R^5$, $R^6$, $R^7$ and $R^8$ are independently selected from H, alkyl (substituted or not), aryl (substituted or not), and one of $R^5$ and $R^6$, and one of $R^7$ and $R^8$ may represent W;

X is carbonyl, sulfonyl, carboxyl, amido or phosphonyl;

Q is N, S, O or C;

n is zero for Q equals S or O, n is 1 for Q equals N, and 2 for Q equals C;

and W is a group of the formula

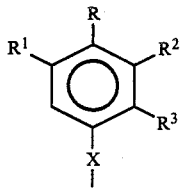

wherein R, $R^1$, $R^2$, $R^3$ and X are as defined above.

2. The emulsion of claim 1 wherein X is carbonyl.

3. The emulsion of claim 1 wherein R is OH and $R^1$ and $R^2$ are alkyl.

4. The emulsion of claim 2 wherein R is OH and $R^1$ and $R^2$ are alkyl.

5. The emulsion of claim 1 wherein $R^1$ and $R^2$ are branched alkyl of 4 to 8 carbon atoms.

6. The emulsion of claim 4 wherein $R^1$ and $R^2$ are branched alkyl of 4 to 8 carbon atoms.

7. The emulsion of claim 2 wherein $R^3$ is H, Q is O, n=0, and $R^5=R^6=R^7=R^8$=alkyl of 1 to 4 carbon atoms.

8. The emulsion of claim 5 wherein $R^3$ is H, Q is O, n=0, and $R^5=R^6=R^7=R^8$=alkyl of 1 to 4 carbon atoms.

9. The emulsion of claim 6 wherein $R^3$ is H, Q is O, n=0, and $R^5=R^6=R^7=R^8$=alkyl of 1 to 4 carbon atoms.

10. The emulsion of claim 2 wherein $R^3$ is H, Q is S, n=0, and $R^5=R^6=R^7=R^8$=alkyl of 1 to 4 carbon atoms.

11. The emulsion of claim 5 wherein $R^3$ is H, Q is S, n=0, and $R^5=R^6=R^7=R^8$=alkyl of 1 to 4 carbon atoms.

12. The emulsion of claim 6 wherein $R^3$ is H, Q is S, n=0, and $R^5=R^6=R^7=R^8$=alkyl of 1 to 4 carbon atoms.

13. A photothermographic element comprising the emulsion of claim 1 on a substrate.

14. The element of claim 13 wherein said substrate comprises polymeric film or paper.

15. The element of claim 13 wherein X is carbonyl.

16. The element of claim 14 wherein X is carbonyl.

17. The element of claim 16 wherein R is OH.

18. The element of claim 17 wherein $R^1$ and $R^2$ are alkyl.

19. The element of claim 17 wherein $R^1$ and $R^2$ are branched alkyl.

20. The element of claim 17 wherein Q=O, n=0, and $R^5=R^6=R^7=R^8$=alkyl of 1 to 4 carbon atoms.

21. The element of claim 19 wherein Q=O, n=0, and $R^5=R^6=R^7=R^8$=alkyl of 1 to 4 carbon atoms.

22. The element of claim 14 wherein additional and separate color forming layers are present on said element.

23. The element of claim 17 wherein additional and separate color forming layers are present on said element.

24. The element of claim 20 wherein additional and separate color forming layer are present on said element.

25. The element of claim 21 wherein additional and separate color forming layers are present on said element.

26. The element of claim 14 wherein additional and separate color forming materials are present within said emulsion.

27. A photothermographic emulsion capable of producing an image having visible color therein upon exposure to actinic radiation and thermal development consisting essentially of a binder, an organic silver salt, silver halide in catalytic proximity to said organic silver salt, spectral sensitizing dye, antifoggant, and a dye forming developer in reactive association with said organic silver salt, said emulsion being characterized by the fact that said developer comprises a compound of the formula:

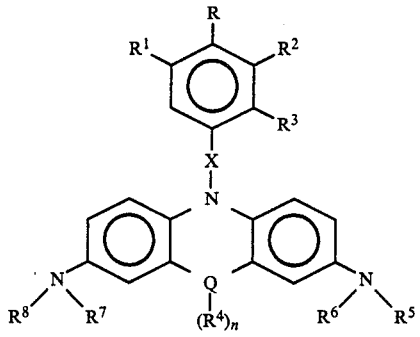

wherein

R=OH, or when $R^3$ is OH, R is H or combined with $R^1$ or $R^2$ to form a fused benzene ring;

$R^1$ and $R^2$ are selected from H, or a substituent having a diameter at least equal to that of —Br and equal to or less than 1,1,2,2,5,5-hexamethyl hexyl, with no more than one of $R^1$ and $R^2$ being H, and $R^1$ or $R^2$ may form with R form a fused benzene ring, and $R^2$ may with $R^3$ form a fused benzene ring;

$R^3$ is H, OH or may form with $R^2$ a fused benzene ring;

$R^4$ is, alkyl (substituted or not), aryl (substituted or note), aralkyl or alkaryl;

$R^5$, $R^6$, $R^7$ and $R^8$ are independently selected from H, alkyl (substituted or not), aryl (substituted or not), and one of $R^5$ and $R^6$, and one of $R^7$ and $R^8$ may represent W;

X is carbonyl, sulfonyl, carboxyl, amido or phosphonyl;

Q is N, S, O or C;

n is zero for Q equals S or 0, n is 1 for Q equals N, and 2 for Q equals C;

and W is a group of the formula

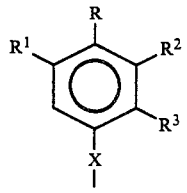

wherein R, $R^1$, $R^2$, $R^3$ and X are as defined above.

28. The emulsion of claim 27 wherein X is carbonyl.

29. The emulsion of claim 27 wherein R is OH and $R^1$ and $R^2$ are alkyl.

30. The emulsion of claim 28 wherein R is OH and $R^1$ and $R^2$ are alkyl.

* * * * *